United States Patent [19]

Hawkins

[11] 4,244,610

[45] Jan. 13, 1981

[54] SLIDNG WINDOW CHANNEL LOCK

[76] Inventor: Donald Hawkins, P.O. Box 1203, Tracy, Calif. 95376

[21] Appl. No.: 89,253

[22] Filed: Oct. 29, 1979

[51] Int. Cl.[3] ..... E05C 5/00

[52] U.S. Cl. ..... 292/67; 242/DIG. 46; 292/343; 292/204

[58] Field of Search ..... 292/67, 68, 342, 343, 292/DIG. 46, DIG. 47, 204

[56] References Cited

U.S. PATENT DOCUMENTS

| | | | |
|---|---|---|---|
| 1,970,879 | 8/1934 | Bell | 292/343 |
| 2,239,214 | 4/1941 | Bakeman | 292/343 |
| 3,378,293 | 4/1968 | Silk | 292/DIG. 46 |
| 3,893,261 | 7/1975 | Cribben | 292/DIG. 46 |
| 4,190,271 | 2/1980 | Hawkin | 292/DIG. 46 |

*Primary Examiner*—Richard E. Moore

*Attorney, Agent, or Firm*—Harris Zimmerman; Howard Cohen

[57] ABSTRACT

A lock for use in conjunction with a window panel slidably supported in a track of a channel member includes a stop member which is permanently and translatably secured in the track of the channel member. The track includes a generally tubular portion extending the length thereof and the stop member includes a generally U-shaped lower portion, with the distal end of the U-shaped portion slidably disposed in the tubular track portion. The stop member includes a web portion extending upwardly from the U-shaped portion, and a top panel extending orthogonally from the upper end of the web. The stop member may be pivoted about the portion engaged in the tubular part of the track to increase the frictional engagement therewith and prevent translation of the stop member. The top panel of the stop member includes obliquely extending edges which are engaged by the sliding window panel to rotate the stop member into the locked position.

7 Claims, 7 Drawing Figures

SLIDNG WINDOW CHANNEL LOCK

BACKGROUND OF THE INVENTION

In the field of construction of dwellings, commercial buildings, and similar structures, there has been a great increase in recent years in the use of windows and vents which employ sliding panels. These windows and vents usually comprise a pair of parallel, spaced apart, horizontal channel members, each having a pair of adjacent tracks therein which receive the window or vent panel and permit them to be slidably and horizontally translated. Often these units are preassembled by original equipment manufacturers using end rails or channel members to join the horizontal channel members together with the panel assembled therein. The prefabricated units are then installed with a minimum of labor in wall openings which are dimensioned to receive the units. Although sliding panel vents and window units cannot be blown open by the wind, they are quite susceptible to being opened in an unconventional manner by vandals and theives. To remedy this situation, there have been devised in the prior art many forms of locks to seal the units and prevent unauthorized entry therethrough. Other lock devices limit the opening afforded by the vent or window to prevent entry therein. In general, these lock devices are an added expense for each window, an expense which is greatly multiplied in a structure having many windows. Also, many of the lock units which require the proper keys for opening are a safety hazard in an emergency, in that they do not permit egress without the use of the proper key. During fires or similar emergencies, the time wasted unlocking a key-locked sliding window may determine the difference between escape and injury or death. Also known in the prior art are devices which obstruct the track of the channel members to limit the opening of the sliding panel. These devices often screw or bolt to the channel member of thr unit, and are thus poorly adapted to provide variable opening of the unit. These devices also add to the cost of each window or vent unit. Furthermore, these devices are removable from the channel member, and must be reinstalled before each use. Moreover, it has been found that these removable devices tend to be pilfered or otherwise permanently removed from window units in hotels, motels, and similar dwellings.

SUMMARY OF THE PRESENT INVENTION

The present invention generally comprises a lock device for a sliding window panel or vent unit which provides a great degree of freedom in selecting the amount of opening afforded by the sliding panel unit. Further, the device of the present invention is simple, permanently installed in a preassembled unit, and very inexpensive. It is also easily manipulated to permit full opening of the sliding panel in an emergency situation.

The device of the present invention is particularly adapted for use in conjunction with sliding panel vent and window units which employ upper and lower channel members having tracks in which the panel slidably translated. In particular, the device is intended for use with channel members having tubular longitudinal portions extending the length of the track in which the sliding unit translates. Such tubular longitudinal portion commonly includes a slot extending the length thereof and providing an extended opening between the tubular portion and the track portion which receives the sliding unit.

The present invention includes a stop member having a generally U-shaped lower portion which is received in the track in which the sliding panel translates. The distal end of the U-shaped portion extends into the slot which joins the tubular portion to the main part of the track. The other end of the U-shaped portion is integrally joined to an upstanding web portion, and the top panel extends orthogonally from the upper end of the web portion. The engagement of the distal end of the U-shaped portion in the slot is one of minimum clearance. As a result, the distal end may translate in the slot only when it is extending directly thereinto. When the stop member is rotated slightly about a pivot comprising the engaging of the distal end in the slot, the angle of the distal end in the slot provides no clearance and results in a highly frictional engagement thereof. As a result of the high frictional engagement, the stop member cannot be translated in the angularly rotated position.

The top panel of the stop member includes obliquely disposed edges at the opposed ends thereof, the edges being disposed to be impinged upon by the sliding panel unit. The oblique edges are inclined so that impingement thereon by the sliding panel unit causes the stop member to rotate into the frictionally engaged, non-translatable disposition in the track. Thus wherever the stop member is disposed along the track, impingement on the stop member by a sliding panel unit will cause the stop member to block translation of the sliding panel unit.

The stop member is non-removably disposed in the crack of the channel member, and may be selectively positioned at any point along the track to limit the translation of the sliding panel unit.

A BRIEF DESCRIPTION OF THE DRAWING

DESCRIPTION OF THE PREFERRED EMBODIMENT

Figure 6:
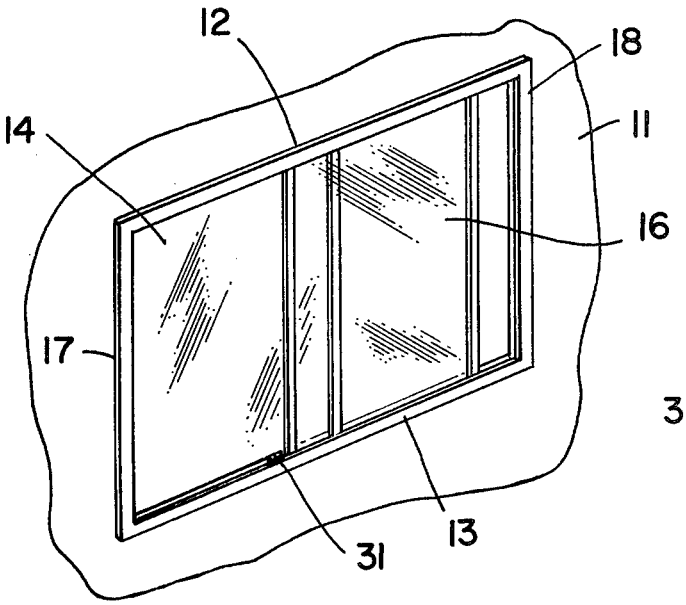
FIG. 6 is a perspective view of the present invention assembled in a sliding panel window unit.

The present invention generally comprises a lock device for use in conjunction with vent or window units which employ sliding panels for opening and closing. As shown in FIG. 6, a typical vent or window unit 11 includes upper and lower channel members 12 and 13 which have a pair of adjacent tracks therein to receive a pair of panel units 14 and 16 in sliding, translatable fashion. A pair of end members 17 and 18 join the like ends of the spaced apart channel members 12 and 13 to form the preassembled unit 11 in which the panel members 14 and 16 are permanently secured.

Figure 1:
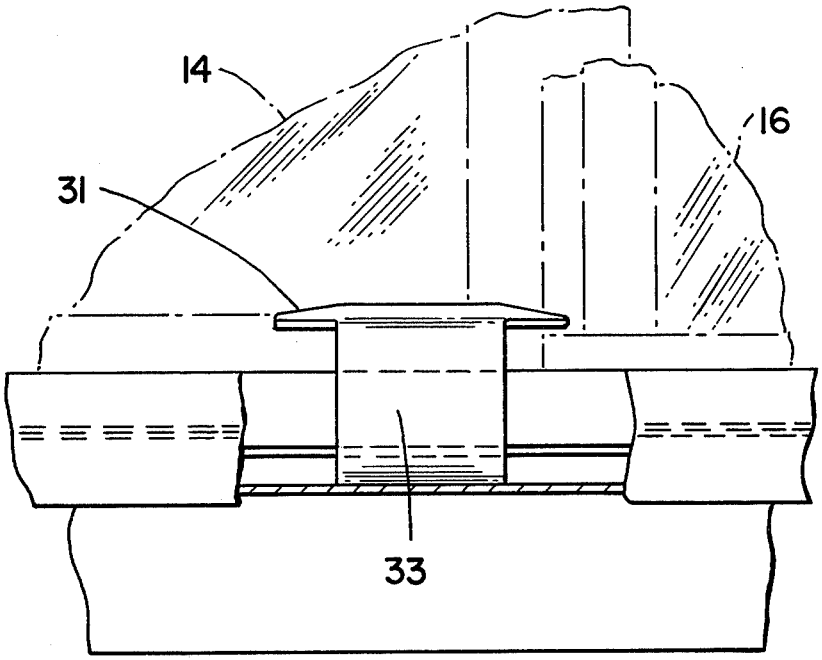
FIG. 1 is a plan elevation of the locking device of the present invention.
Figure 2:
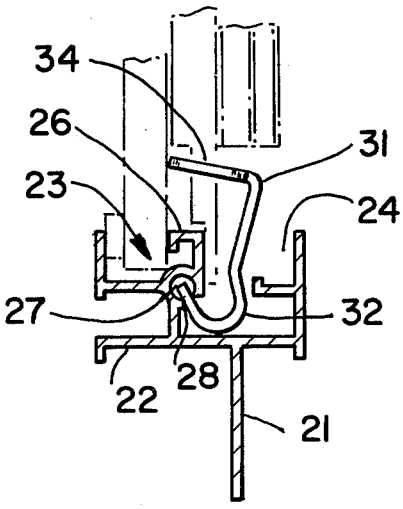
FIG. 2 is a cross-sectional elevation of the present invention, shown in the unlocked position.
Figure 3:
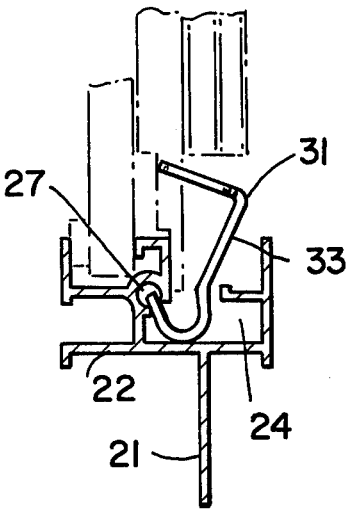
FIG. 3 is a cross-sectional elevation of the present invention, shown in the locked position.

The channel member 13 includes a subjacently dependent, longitudinally extending vertical web member 21, as shown in FIGS. 2 and 3. A longitudinally extending, horizontal web member 22 is joined to the upper edge of the member 21 in offset T fashion. The channel member is provided with an outer track 23 and an inner track 24 extending longitudinally and disposed in parallel relationship. The tracks 23 and 24 are separated by a C-shaped medial member 26. Disposed at the base of the C-shaped member 26 is a longitudinally extending, hollow, tubular member 27. A longitudinally extending slot 28 extends from the hollow interior of the tubular member 27 obliquely downwardly to the lower part of the track 24.

It may be appreciated that the description above of the channel member 13 is a general description of a type of channel member commonly used in sliding panel unit construction. Although the general details of the construction are not critical to the present invention, the portion of the channel comprising the tubular member 27, the slot 28, and the track 24 are necessary for the proper installation and operation of the present invention.

Figure 7:
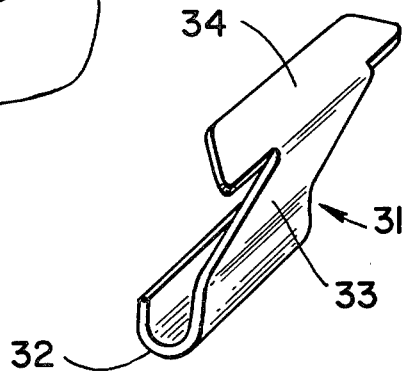
FIG. 7 is a perspective view of the stop member of the present invention.

With reference to FIGS. 2, 3, and 7, the present invention provides a stop member 31 which is permanently secured in the track 24 of the channel member 13. The stop member 31 includes a generally U-shaped lower portion 32 which is disposed in the bottom part of the track 24. The distal end of the U-shaped portion 32 extends from the track 24 through the slot 28 and into the cavity of the tubular portion 27. The slot 28 is only slightly wider than the thickness of the distal end of the portion 32 of the stop member 31. As a result, there is little clearance for the distal end of the portion 32, and this clearance exists only when the distal end is aligned substantially with the plane of the slot 28. When this alignment condition is present, there is sufficient clearance for the distal end to freely translate longitudinally.

Figure 4:
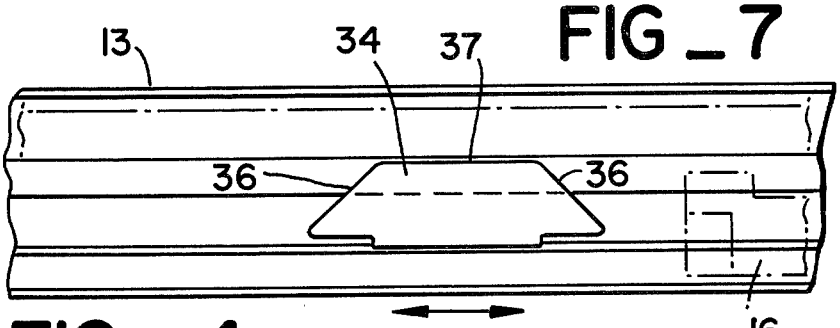
FIG. 4 is a top view of the present invention in the unlocked position, as in FIG. 2.
Figure 5:
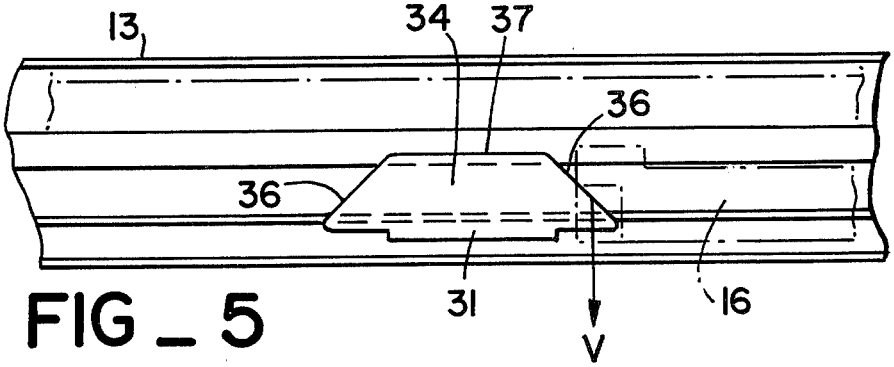
FIG. 5 is a top view of the present invention in the locked position, as in FIG. 3.

The proximal end of the U-shaped portion 32 is joined integrally to an upwardly extending web portion 33. The height of the web portion 33 is sufficient so that the upper end thereof extends above the channel member 13. A top panel 34 is integrally joined to the upper edge of the web portion 33, and is disposed substantially orthogonally thereto. At the opposed ends of the stop member, the edges 36 are both obliquely inclined towards the same side edge 37, as shown in FIGS. 4 and 5.

As explained in the foregoing description, the stop member 31 is translatable along the track 24 when the distal end of the U-shaped portion 32 extends directly into the slot 28 of the tubular member 27. This condition is fulfilled when the stop member 31 is in its most upright position, as shown in FIG. 2 an FIG. 4. The weight distribution of the stop member is such that the normal resting position of the stop member is rotated slightly clockwise with respect to the sliding position, as shown in FIGS. 3 and 5. In the rotated, less upright position, the distal end frictionally engages the slot 28 so that it translates therein with difficulty. It may be appreciated that whenever a sliding panel unit 14 or 16 impinges on the stop member 31, as shown in FIG. 5, the oblique disposition of the edges 36 cause the longitudinally directed force exerted by the panel unit on the stop member to be partially transformed vectorially into a vector moment V which acts to rotate the stop member into further frictional engagement in the slot 28. As a result, the more force that is applied to translate the panel unit, the more frictional engagement is created by the stop member. Therefore the sliding panel units cannot be translated past the stop member, nor can the sliding panel units be used to force the stop member to translate along the track 24.

It may be appreciated that the stop member 31 easily may be translated to any desired position along the track 24 by an individual situated inside of the window assembly 11. Thereafter, the sliding panel unit may be opened until it impinges upon the stop member. Further translation, even forceful manipulation by a would-be thief or burglar, is impossible.

It should be emphasized that the stop member 31 is permanently disposed in the track 24, and cannot be removed either purposely or inadvertently. Also, the stop member 31 easily may be moved to permit full opening of the sliding panel unit in an emergency situation to permit escape therethrough. Also, the stop member 31 is easy and inexpensive to fabricate, and requires no locking device or key for actuation.

I claim:

1. In conjunction with a sliding panel assembly comprising a channel member having a recessed track therealong, a hollow tubular longitudinal member, a longitudinally disposed slot extending between said track and said tubular member, and a panel slidably disposed in said track; a lock device for limiting translation of said panel, including a stop member having a lower portion with a distal edge extending into and engaging said slot with minimal clearance, an upwardly extending web portion joined to the proximal edge of said lower portion, and means on said web portion for rotating said stop member about said engagement with said slot to engage said slot frictionally and immobilize said stop member.

2. The lock device of claim 1, wherein said lower portion comprises a generally U-shaped member extending longitudinally in said track.

3. The lock device of claim 1, wherein said means includes a top panel extending from the upper edge of said web portion.

4. The lock device of claim 3, wherein said top panel extends substantially transversely from said web portion.

5. The lock device of claim 3, wherein said top panel includes longitudinally opposed edges, said edges tapering toward a common side edge and disposed to convert a portion of any longitudinal force applied thereto to a rotational movement to increase said frictional engagement in said slot.

6. The lock device of claim 5, wherein said longitudinally opposed edges are disposed to be impinged upon by said panel.

7. The lock device of claim 1, wherein said distal edge is slidably disposed in said slot and said stop member is selectively positionable along said track.

* * * * *